US005477833A

United States Patent [19]

Leighton

[11] Patent Number: 5,477,833

[45] Date of Patent: Dec. 26, 1995

[54] FUEL SYSTEM FOR FUEL INJECTED INTERNAL COMBUSTION ENGINES

[75] Inventor: Sam R. Leighton, Nedlands, Australia

[73] Assignee: Orbital Engine Company (Australia) Pty. Limited, Balcatta, Australia

[21] Appl. No.: 129,122

[22] PCT Filed: May 14, 1992

[86] PCT No.: PCT/AU92/00216

§ 371 Date: Oct. 12, 1993

§ 102(e) Date: Oct. 12, 1993

[87] PCT Pub. No.: WO92/20915

PCT Pub. Date: Nov. 26, 1992

[30] Foreign Application Priority Data

May 15, 1991 [AU] Australia ..... PK6138

[51] Int. Cl.[6] ..... F02D 41/34; F02M 69/14

[52] U.S. Cl. ..... 123/497; 123/447; 123/533

[58] Field of Search ..... 123/497, 447, 123/531, 533, 456, 494

[56] References Cited

U.S. PATENT DOCUMENTS

| | | | |
|---|---|---|---|
| 3,967,598 | 7/1976 | Rachel | 123/447 |
| 4,248,194 | 2/1981 | Drutchas et al. | 123/497 |
| 4,565,173 | 1/1986 | Oshiage et al. | 123/357 |
| 4,920,942 | 5/1990 | Fujimori et al. | 123/497 |
| 4,940,034 | 7/1990 | Heim et al. | 123/497 |
| 4,951,636 | 8/1990 | Tuckey et al. | 123/497 |
| 4,955,350 | 9/1990 | Albertson | 123/533 |
| 4,971,005 | 11/1990 | Dyer et al. | 123/494 |
| 4,989,568 | 2/1991 | Sougawa | 123/456 |
| 4,993,394 | 2/1991 | McKay et al. | 123/533 |
| 5,055,758 | 10/1991 | Hock | 123/497 |
| 5,156,133 | 10/1992 | Sugimoto et al. | 123/533 |
| 5,237,975 | 8/1993 | Betki et al. | 123/497 |
| 5,289,812 | 3/1994 | Trombley et al. | 123/533 |

FOREIGN PATENT DOCUMENTS

| | | |
|---|---|---|
| 79126/87 | 3/1988 | Australia . |
| 43905/89 | 5/1990 | Australia . |
| 0055417 | 7/1982 | European Pat. Off. . |

*Primary Examiner*—Thomas N. Moulis

*Attorney, Agent, or Firm*—Nikaido, Marmelstein, Murray & Oram

[57] ABSTRACT

A method of operating a fuel system having a fuel pump (15) to supply fuel to a fuel metering apparatus (23) operable to provide metered quantities of fuel for injection to an engine, and an electronic controller (22) responsive to a plurality of input signals to determine the engine fuel demand and to control the activation of the fuel metering apparatus ( 23 ) to deliver a quantity of fuel to meet said fuel demand. The method comprising maintaining a fuel supply to said fuel metering apparatus (23) within predetermined fuel pressure or fuel level parameters, and cyclically operating said fuel pump-to maintain said fuel supply within said parameters. Further providing a signal from the sensor (18) to an electronic controller (23) indicative of the pressure of the fuel supply at the fuel metering apparatus (23) as one of said input signals to be processed by the electronic controller (23) in the control of the fuel metering apparatus (22). The accuracy of the fuel metering is thereby not adversely affected by the intermittent operation of the pump ( 15 ). The pump ( 15 ) preferably provides fuel to a closed chamber that acts in the manner of an accumulator (16), and a pressure sensor (18) provides an input signal to the electronic controller (22) indicative of the pressure of the fuel available to the fuel metering apparatus (23) from the accumulator (16). Alternatively the chamber may maintain the fuel between predetermined levels at a substantially steady or variable pressure.

18 Claims, 1 Drawing Sheet

FUEL SYSTEM FOR FUEL INJECTED INTERNAL COMBUSTION ENGINES

Figure 1:
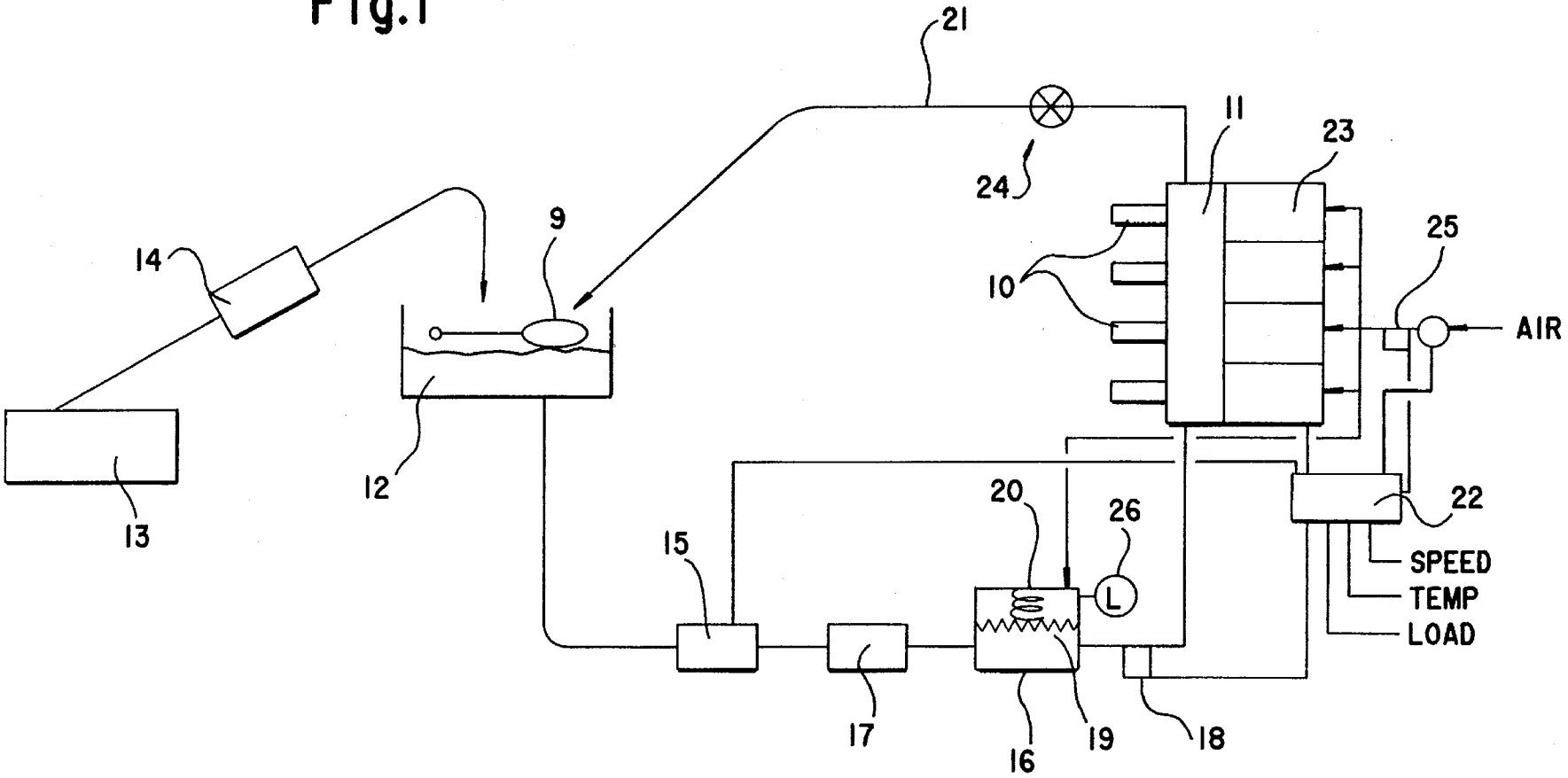

This invention relates to a fuel system for delivering metered quantities of fuel to an internal combustion engine and is particularly applicable to fuel systems incorporating a fuel injector which can deliver fuel either directly to the engine combustion chamber or to the air induction system of the engine.

It is customary to provide in a fuel injection system a fuel pressure regulator to maintain the fuel supply at a preset pressure, as the pressure of the fuel is relevant to the process of motoring the fuel to the engine. Where a conventional pressure regulator is used, it is necessary to provide a fuel return line from the regulator to the fuel reservoir, thus effectively doubling the length of fuel line between the fuel reservoir and the fuel injection equipment that convey fuel at high pressure. The increase in fuel line length represents an expense in both the supply of material and assembly thereof, and also significantly increases the risk of high pressure fuel leakage developing.

From the point of view of safety, and also economy, it is desirable to reduce the extent of fuel lines between the fuel reservoir and the engine. This is particularly so in marine engine installations where leaked fuel can collect in an enclosed area and present a major fire hazard.

More importantly the energy consumed in pumping fuel at a rate substantially in excess of the engine fuel requirement represents a significant energy waste. Currently the fuel pump in a fuel injection system is normally electrically driven and operates continuously, thus consumes substantial electrical energy circulating fuel that is not required. This energy waste particularly occurs during low to medium load and/or speed operation of the engine and as the energy to drive the fuel pump is supplied directly or indirectly from the engine, energy wasted in pumping excess fuel represents a significant component of the fuel consumption of the engine.

There has been proposed such as in U.S. Pat. Nos. 3,967,598 and 4,565,173, fuel injection systems wherein the fuel pump is operated cyclically so as to maintain a substantially constant fuel supply pressure to the injector, and also so as to avoid the necessity of providing a return fuel circuit from the pump to the fuel tank or reservoir.

In both of these proposals, the fuel pump is required to operate at a duty cycle, directly related to the injection frequency, which in turn is related to engine speed. A pump operating on a duty cycle of such high frequency inherently has a low pumping efficiency, and consequently a low energy consumption efficiency. Further, the operation of a pump in a high frequency cycling mode severely reduces the life of the pump.

Although the fuel system proposed in U.S. Pat. No. 3,967,598 does provide an accumulator downstream of the fuel pump, the pump is still required to operate on a cyclic basis at a frequency equal to the frequency of injection. The accumulator is only provided for the purpose of attempting to substantially maintain the designed pressure for the supply of fuel to the injector and to overcome mechanical and hydraulic induced time delays which would otherwise prevent the attaining of substantial synchronism between the injector cycle and the pump cycle.

It is the object of the present invention to provide a method and apparatus for the supply of fuel to an engine which enables the maintenance of accurate metering of the fuel to the engine in accordance with the engine fuel demand, avoids the necessity of a high pressure fuel return line to the fuel reservoir and improve the operational efficiency of the fuel pump.

With this object in view there is provided according to the present invention a method of operating a fuel system supplying metered quantities of fuel for delivery to an internal combustion engine, said system having a cyclically operable fuel pump, a metering means to receive fuel supplied by the pump, and a processor to control the metering means to deliver a metered quantity of fuel to the engine, said processor determining the metered quantity of fuel required by the engine in response to signal inputs thereto indicating engine operating conditions, said method including intermittently operating said pump under control by the processor to maintain a fuel supply to the metering means at a pressure between selected limits, said limits being selected so that the pump means delivers during each period of operation a quantity of fuel greater than a multiple of the maximum single metered quantity of fuel deliverable by the metering means, and sensing the pressure of the fuel supply to the metering means, and inputting to the processor a signal indicative of the sensed pressure, said processor applying said fuel pressure signal in the control of the metering means to deliver the required quantity of fuel.

Conveniently the fuel is supplied by the pump to a chamber, preferably a closed chamber, from which the fuel is directly supplied to the fuel metering means. The chamber may act in the manner of an accumulator, and a pressure sensor provides the input signal to the processor indicative of the pressure of the fuel available to fuel metering means from the accumulator.

The processor can be adapted to control the operation of the fuel pump in accordance with the pressure input signal so that the pressure of the fuel in the accumulator is maintained between the selected maximum and minimum pressures. Alternatively, the cycling of the pump may be controlled by an input signal to the processor indicative of the fuel level in the chamber or by a fuel level sensor directly controlling the operation of the pump.

It will be appreciated that the pressure of the fuel supplied to the fuel metering means will influence the rate of delivery of the fuel by the metering means such as the rate of flow of the fuel through a metering orifice. Thus the processor is required to take account of the pressure of the fuel supply in the control of the quantity of fuel delivered to the engine. Normally the fuel metering means includes a selectively opening port or nozzle and the period of opening of the nozzle or port is varied to control the amount of fuel delivered. Thus a variation in the pressure drop across the nozzle or port will influence the rate of fuel flow when the port or nozzle is opened, and the processor can control that period in accordance with the pressure of the fuel supplied to the port or nozzle together with other engine operating conditions to achieve delivery of the correct amount of fuel. The fuel pressure sensor may alternatively be arranged to sense the pressure differential between the fuel supply and a gas into which the fuel is delivered during metering. This input can similarly be used by the processor in achieving accurate metering of the fuel.

The above fuel supply system has the advantage that no pressurised fuel return line is required from the high pressure side of the pump, and the pump is only operated to meet the actual fuel demand of the engine, thus representing a substantial saving in energy which would normally be used merely to pump fuel from the reservoir which was subsequently returned to the reservoir. Further as the processor receivers an input indication the actual pressure of the fuel supply to the fuel metering means it is not necessary to maintain the fuel supply pressure substantially constant. Accordingly the fuel pump can be operated on a non-regular intermittent basis with substantial time intervals between successive operating periods. The pump can thus operate at the designed speed at high efficiency and low overall energy consumption and reduced wear rate.

In addition, by having a sensor to deliver a signal to the processor to indicate the actual pressure of fuel available to the fuel metering means, no pressure regulation is required and the processor alone can accurately control the fuel metering means to ensure the correct fuel quantity is delivered to the engine to meet the fuel demand thereof at all fuel supply pressures.

Currently there are in use fuel injection systems wherein the metered quantity of fuel is delivered to the engine entrained in a gas, usually air. In such injection systems it is common to effect the metering of the fuel as it is delivered into the gas and thus the pressure of the gas is relevant to the fuel metering process. Accordingly, when the fuel supply pump is intermittently operated, to control the pressure of the fuel supply to the fuel metering means, the processor may be arranged to vary the pressure of the fuel supply in response to variations in the pressure of the gas into which the fuel is metered to control the pressure differential therebetween. Thus a substantially constant pressure differential can be maintained between the fuel and gas. Alternatively the pressure differential between the fuel and the gas can be sensed and controlled to achieve the substantially constant pressure differential.

Also it is desirable under some engine operating conditions to vary the pressure of injection of the fuel or fuel - gas mixture to the engine. This can be achieved with the presently proposed fuel supply system due to the ability to vary the fuel supply pressure without adversely affecting the fuel metering process.

There is also provided according to the present invention a fuel system for an internal combustion engine, said system comprising a fuel pump for delivering fuel from a fuel reservoir to a fuel metering means, including an intermediate reservoir downstream of the fuel pump, sensor means to generate a signal indicative of the pressure of the fuel in the intermediate reservoir, and a processor to receive and process said signal to maintain said pressure of the fuel in the intermediate reservoir within predetermined limits by selectively switching the fuel pump on and off. Preferably the processor also responds to the pressure of the fuel supply in the intermediate reservoir in the control of the fuel metering means to meet said fuel demand, whereby the accuracy of the fuel metering is not adversely affected by the cycling of the operation of the pump.

The invention will be more readily understood from the following description of one practical arrangement of the fuel system as illustrated in the accompanying drawing.

FIG. 1 is a schematic representation of the fuel system particularly applicable to marine engines.

Referring now to FIG. 1, the plurality of fuel metering and injector devices 10 are arranged so that each device delivers fuel to a respective cylinder or cylinder inlet port of a multi-cylinder engine. It is to be understood that the number of fuel metering and injector devices will vary with the character of the fuel system and there may be a single device even for a multi-cylinder engine.

Each of the fuel metering and injector devices 10 receive fuel from a common fuel rail 11 which is supplied with fuel from the fuel reservoir 12. As the installation shown is for use in marine applications, the fuel reservoir 12 in turn receives fuel from the remote fuel tank 13 via the lift pump 14. The fuel reservoir 12 is fitted with a float valve 9 which will close to prevent the delivery of fuel by the lift pump 14 when the fuel level in the reservoir 12 has reached a preset level. The provision of the fuel reservoir 12, lift pump 14 and float valve 9 are for the purposes of complying with U.S. regulations relating to marine engines. These regulations do not apply in other installations such as automobiles or other motor vehicles, in which installations the fuel reservoir 12 would be the conventional fuel tank of the vehicle.

The high pressure fuel pump 15 draws fuel from the reservoir 12 and delivers it to the accumulator 16 via the fuel filter 17. The accumulator 16 is in the form of a closed chamber having at least one deflectable or movable wall 19 which is preloaded by the spring 20 or the like resilient component. The wall 19 is displaced or deflected upwardly as viewed in FIG. 1 by the pressure of the fuel and as fuel is delivered to the accumulator and downward by the spring as fuel is withdrawn. Thus the pressure of the fuel in the accumulator can be maintained within preset limits while fuel is being delivered therefrom to the fuel rail 11 and hence to the metering and injector units 10. The accumulator 16 may alternatively be constructed to maintain a near steady pressure of the fuel therein with the fuel level moving between set upper and lower levels with a position sensor to issue a signal to indicate the fuel level.

The pressure sensor 18 is responsive to the pressure of the fuel in the accumulator 16 or anywhere upstream thereof and down stream of the injector devices 10, and generates a signal for input to the ECU 22 which is programmed to switch the pump 15 on and off so as to maintain the pressure in the accumulator 16 between preset maximum and minimum values. Thus when the rate of fuel consumption is low the pump will be switched off for long periods until sufficient fuel is consumed from the accumulator to allow the pressure to drop from the maximum to the minimum preset value. Even at maximum fuel consumption rates, the operation of the fuel pump 15 will be cycled on and off as the capacity of the accumulator is selected to be a multiple of the maximum fuel consumption rate per cycle of the injector system. It will be appreciated that a similar cycling of the pump operation will be obtained by the ECU 22 receiving signals from position sensors indicating the fuel level such as level sensor 26 in the accumulator. The capacity of the accumulator and the permitted variation in fuel pressure or fuel level therein is preferably selected is that, even at maximum fuel consumption rate, the pump is switched on at intervals corresponding to 50 or more fuel deliveries by the injectors. The on and off cycling of the fuel pump will provide a substantial reduction in energy consumption by the fuel system, particularly consumption of energy in the form of electrical power generated by an alternator driven by the engine. This saving is particularly significant when the engine is operating at low to medium loads and/or speeds.

The signal input to the ECU 22 by the pressure sensor 18 is also used in the control of the fuel metering component 23 of the fuel metering and injector devices 10 so that in determining the amount of fuel required each fuel delivery event, account will be taken of the actual fuel pressure at that point in time. This enables the accurate calculation of the required period of opening of the fuel metering component to deliver the quantity of fuel calculated to meet the fuel demand of the engine.

The ECU also receives the conventional inputs for determination of the engine fuel demand such as engine speed, engine bad and engine temperature.

As the fuel pump 15 only operates when fuel is required to maintain the fuel supply within the preset pressure or level limits, it is not necessary to provide a return line from the fuel rail 11 to the reservoir 12. However, for other reasons, such as to ensure against the accumulation of fuel vapour in the fuel rail 11, having regard to the temperature of the environment in which the fuel rail is located, it can be desirable in some installations to provide for the bleeding of a small amount of fuel back from the fuel rail to the reservoir 12. This can be achieved by providing an appropriate return line 21 which incorporates a flow control orifice 24 selected so that the amount of fuel returned to the reservoir 12 is only that sufficient to prevent vapour accumulating in the rail 11. A solenoid actuated valve may be provided in the return line 21 which is opened under the control of the ECU 22 in accordance with a preset cycle or in response to operating conditions such as engine temperature, start-up conditions or fuel temperature.

The above described method and apparatus for supplying fuel to an engine is applicable to fuel injection systems wherein fuel alone or fuel and gas such as air are delivered to the engine, including fuel injector systems wherein the metered quantity of fuel is entrained in air prior to or during injection. A typical construction of such a fuel metering and injection system is disclosed in U.S. Pat. No. 4,934,329 the disclosure of which is incorporated herein by reference.

In a fuel injection system wherein the fuel is metered into air to be carried thereby to the engine, the ECU 22 can also receive an input signal indicative of the pressure of that air to be used in controlling the fuel metering. Also air at that pressure, which may to sub-atmospheric, can be applied to the movable wall 19 of the accumulator 16 to complement the load applied by the spring 20. In this arrangement the pressure of the fuel in the accumulator will be related to the air pressure in a preset manner. This is beneficial in the fuel metering operation in that a substantially steady pressure differential can be achieved between the fuel and air supplies. It can also be desirable to increase the gas pressure at high load operation of the engine relative to the pressure at low to medium load conditions, or in relation to engine speed either alone or in combination with engine load. The processor can be arranged to determine when such a gas pressure charge is to be effected by input signals indicating engine load and/or speed or in response to the fuel requirement of the engine being above a predetermined level.

I claim:

1. A method of operating a fuel system supplying metered quantities of fuel for delivery to an internal combustion engine, said system having a cyclically operable fuel pump, a metering means to receive fuel supplied by the pump, and a processor to control the metering means to deliver a metered quantity of fuel to the engine, said processor determining the metered quantity of fuel required by the engine in response to signal inputs thereto indicating engine operating conditions, said method including intermittently operating said pump under control of the processor to maintain a fuel supply to the metering means at a pressure between selected limits, said limits being selected so that the pump delivers during each period of operation a quantity of fuel greater than a multiple of the maximum single metered quantity of fuel deliverable by the metering means, sensing the pressure of the fuel supply to the metering means, and inputting to the processor a signal indicative of the sensed pressure, said processor applying said fuel pressure signal in the control of the metering means to deliver the required quantity of fuel.

2. A method of operating a fuel system as claimed in claim 1 wherein the processor also applies said fuel pressure signal in the control of the intermittent operation of the pump to maintain the fuel pressure within said limits.

3. A method of operating a fuel system as claimed in claim 2, wherein the fuel pump delivers the fuel to an accumulator.

4. A method of operating a fuel system as claimed in claim 1 wherein the fuel pump delivers fuel to an accumulator, and the intermittent operation of the pump is controlled in response to predetermined variations in the pressure of the fuel in the accumulator.

5. A method of operating a fuel system as claimed in claim 4 including sensing the pressure of the fuel in the accumulator, and inputting to the processor a signal indicative of said sensed fuel pressure, said processor applying said signal in the control of the intermittent operation of the pump.

6. A method of operating a fuel system as claimed in claim 1 wherein the metering means delivers the metered quantity of fuel into a gas charge, and said sensing of the pressure of the fuel is determined by reference to the pressure differential between the fuel and said gas charge.

7. A method of operating a fuel system supplying metered quantities of fuel for delivery to an internal combustion engine, said system having a cyclically operable fuel pump, a metering means to receive fuel supplied by the pump and a processor to control the metering means to deliver a metered quantity of fuel into a gas charge delivered to the engine, said processor determining the metered quantity of fuel required by the engine in response to signal inputs thereto indicating engine operating conditions, said method including intermittently operating said pump under control of the processor to maintain a fuel supply to the metering means at a pressure between selected limits, said limits being selected so that the pump delivers during each period of operation a quantity of fuel greater than a multiple of the maximum single metered quantity of fuel deliverable by the metering means, sensing the pressure of the fuel supply to the metering means by reference to a pressure differential between the fuel and said gas charge, inputting to the processor a signal indicative of the sensed pressure, said processor applying said fuel pressure signal in the control of the metering means to deliver the required quantity of fuel, and controlling the pressure of the gas charge by said processor to vary said gas charge pressure in response to predetermined changes in engine load and/or speed.

8. A method as claimed in claim 7 wherein the processor increases the gas charge pressure when the engine fuel requirement is above a predetermined level.

9. A fuel system for an internal combustion engine, said system comprising a fuel pump for delivering fuel from a fuel reservoir to a fuel metering means, including an intermediate reservoir downstream of the fuel pump and located between the fuel pump and the fuel metering means, sensor means to generate a signal indicative of the pressure of the fuel in the intermediate reservoir, and a processor to receive and process said signal to maintain said pressure of the fuel in the intermediate reservoir within predetermined limits by selectively and intermittently switching the fuel pump on and off to deliver during each period of operation a quantity of fuel greater than a multiple of the maximum single metered quantity of fuel deliverable by the metering means.

10. A fuel system for an internal combustion engine, said system comprising a fuel pump for delivering fuel from a fuel reservoir to a fuel rail in communication with a fuel metering means, including an intermediate reservoir downstream of the fuel pump and located between the fuel pump and said fuel rail, sensor means to generate a signal indicative of the pressure of the fuel in the intermediate reservoir, and a processor to receive and process said signal to maintain said pressure of the fuel in the intermediate reservoir within predetermined limits by selectively switching the fuel pump on and off.

11. The method of operating a fuel system as claimed in claim 3, wherein fuel passes through an accumulator located between the fuel pump and the fuel metering means.

12. The method of operating a fuel system as claimed in claim 3, wherein fuel passes through an accumulator located between the fuel pump and a fuel rail in communication with said metering means.

13. The method of operating a fuel system as claimed in claim 3 wherein the accumulator stores during each period of pump operation said quantity of fuel greater than a multiple of the maximum single metered quantity of fuel deliverable by the metering means.

14. A fuel system for an internal combustion engine, said system comprising a fuel pump for delivering fuel from a fuel reservoir to a fuel metering means, including an intermediate reservoir downstream of the fuel pump, sensor means to generate a signal indicative of the pressure of the fuel in the intermediate reservoir, and a processor to receive and process said signal to maintain said pressure of the fuel in the intermediate reservoir within predetermined limits by selectively and intermittently switching the fuel pump on and off to deliver during each period of operation a quantity of fuel greater than a multiple of the maximum single metered quantity of fuel deliverable by the metering means.

15. A fuel system as claimed in claim 9 wherein the processor is arranged to process said signal indicative of the pressure of the fuel in the intermediate reservoir in the control of the fuel metering means to deliver the quantity of fuel to meet the engine fuel demand.

16. The fuel system as claimed in claim 14 wherein the intermediate reservoir stores during each period of pump operation a quantity of fuel greater than a multiple of a maximum single metered quantity of fuel deliverable by the fuel metering means.

17. A method of operating a fuel system as claimed in claim 1, wherein the fuel pump delivers fuel to an accumulator, and the intermittent operation of the pump is controlled in response to predetermined variations in the level of the fuel in the accumulator.

18. A method of operating a fuel system as claimed in claim 17 including sensing the level of the fuel in the accumulator, and inputting to the processor a signal indicative of the sensed fuel level, said processor applying said signal in the control of the intermittent operation of the pump.

* * * * *